United States Patent [19]

Villavicencio

[11] 4,231,136

[45] Nov. 4, 1980

[54] BAGASSE DEPITHING

[75] Inventor: Eduardo J. Villavicencio, Mexico City, Mexico

[73] Assignee: Process Evaluation & Development Corporation, Dallas, Tex.

[21] Appl. No.: 937,575

[22] Filed: Aug. 28, 1978

Related U.S. Application Data

[63] Continuation of Ser. No. 811,090, Jun. 29, 1977, abandoned, which is a continuation-in-part of Ser. No. 624,686, Oct. 22, 1975, abandoned.

[51] Int. Cl.[2] ..... D01B 1/30; D01B 1/38; D01B 1/50

[52] U.S. Cl. ..... 19/7; 19/8; 19/24; 19/26; 241/152 R

[58] Field of Search ..... 19/7, 8, 26, 34, 90, 19/65 R, 66 R, 105, 24, 25, 27, 28; 241/152 R, 154, 152 A, 157, 152

[56] References Cited

U.S. PATENT DOCUMENTS

| | | | |
|---|---|---|---|
| 1,143,106 | 6/1915 | Davies et al. | 241/154 X |
| 2,316,590 | 4/1943 | Johnson | 19/90 |
| 2,695,755 | 11/1954 | Denovan et al. | 241/154 X |
| 2,812,552 | 11/1957 | Horton et al. | 19/90 |
| 2,969,192 | 1/1961 | Furmanek et al. | 241/154 |
| 3,006,561 | 10/1961 | Eberl et al. | 241/152 R X |
| 3,111,718 | 11/1963 | Nutter et al. | 19/105 |
| 3,273,807 | 9/1966 | Wright | 241/157 X |
| 3,537,142 | 11/1970 | Villavicencio | 19/26 |
| 3,688,345 | 9/1972 | Villavicencio | 19/7 |

FOREIGN PATENT DOCUMENTS

| | | | |
|---|---|---|---|
| 771519 | 7/1934 | France | 19/90 |
| 269173 | 11/1950 | Switzerland | 19/26 |

*Primary Examiner*—Louis Rimrodt
*Attorney, Agent, or Firm*—Michael J. McGreal

[57] ABSTRACT

The pith removal from bagasse fiber is significantly enhanced by the flow of fiber directly from one depithing zone to a second depithing zone without any intermediate settling or pilings of the fiber. The fiber is maintained in a separated condition during the flow from one depithing zone to another depithing zone. The result is a bagasse fiber having a greater quantity of the pith removed with less fiber damage. It is also advantageous to provide a number of conveyors to transport fibrous material to a dual zone depithers and for the removal of depithed fiber and pitch from these depithers. This reduces fiber handling before, during and after depithing.

8 Claims, 3 Drawing Figures

BAGASSE DEPITHING

This application is a continuation of application Ser. No. 811,090, filed June 29, 1977, now abandoned, which in turn is a continuation-in-part of U.S. application Ser. No. 624,686, filed Oct. 22, 1975, now abandoned.

This invention relates to an improved system, apparatus and method for processing fibrous vegetable materials so as to separate them into two portions, one of which is substantially pith free and the other of which contains a major portion of the pith.

The improved system consists of one or more conveyors which feed the fibrous vegetable materials such as bagasse, bamboo, corn stalks or the like to a plurality of dual depithing zone depither devices, a conveyor for transporting pith from the first depithing zone, and a conveyor for removing fiber from a second depithing zone. There may additionally be a conveyor or like device for removing pith from the second depithing zone. Such a system mechanizes the handling of the fibrous material before, during and after the fiber-pith separation. The dual zone fiber depithing apparatus which is used for this system has two vertically disposed interconnected depithing zones, with the partially depithed fiber from the first depithing zone falling in an air separated state from the first depithing zone to the second depithing zone. It is essential that the fiber flow from the first depithing zone to the second depithing zone without any significant settling of the fiber. That is, the present improvement is not applicable to fiber which is depithed once, collected and then put through the depither a second time. It is essential that the fiber entering the second depithing zone be in as deaggregated and air separated condition as possible. The fiber falls by gravity from the first depithing zone to the second depithing zone in a vertically oriented condition. It is theorized that a highly deaggregated feed to the second depithing zone provides a more efficient working on the fiber and thus more effective pith removal. The result is also a fiber of greater length and having less abrasive damage.

The depithing apparatus and method of this invention separates fiber-containing stalk materials into fiber and pith fractions. The separated fractions can be used as desired. For example, the fiber portion can be used for pulp in the paper industry or as a basic raw material for making hardboard of various types. The pith fraction can be used as animal feed, chicken litter, animal bedding, or can be burned as fuel in industrial or heating boilers. The apparatus and method of this invention is especially suitable for obtaining substantially pith-free fiber from sugarcane bagasse for paper-making purposes, but its use is not restricted to sugarcane bagasse alone. The apparatus and method is also suitable for processing other material such as bamboo, corn stalks, straw, flax, rice hulls and similar vegetable matter.

The fibers of such materials are suitable for the production of pulp for use in paper or alpha-cellulose production, or other purposes, but their commercial use in such fields has been handicapped by the presence of varying amounts of pith and other non-fibrous material which is intimately admixed with the fibers, and which has little or no value in such pulps. Its separation from the fibers by presently known methods is quite costly, and there is likely to be excessive fiber damage. That is, the techniques which very effectively remove pith excessively damage the fiber, while the techniques which provide a milder treatment usually do not remove a sufficient amount of pith.

Bagasse is the name given to the cellular material which forms the remains of sugarcane after the sugar-containing juice has been extracted. In processing raw sugarcane, the cane stalks are first fed into a crushing roller and then into a series of roller-type mills which squeeze the cane and force the sugar-containing juice from the broken cells for further processing and refining treatment. After substantially all of the sugar-containing juice has been expelled from the cane, the remainder, which is then called bagasse, consists of relatively long fibers of substantially pure cellulose together with a large amount of pith, which consists of broken cells and other materials, as well as 2 to 3 percent by weight of retained sugar. At this stage, the moisture content of the bagasse is relatively high, generally ranging between 48 and 52 percent by weight. Heretofore it has been customary to use this bagasse as a fuel for heating and refining the expressed juices, but this is relatively inefficient because of the high percentage of retained moisture in the bagasse. It has been recognized that the long cellulosic fibers retained in bagasse have a high degree of potential utility for such purposes as paper pulp and the like, but the presence of the retained pith has heretofore prevented the economical utilization of the fiber because of the detrimental effect of the retained pith on the finished product. However, if the bagasse is processed in too vigorous a manner, the pith is broken or otherwise damaged during pith removal. Although the pith is removed and that problem solved, such fiber is not that useful for a paper pulp.

It is an important object of the present invention, therefore, to provide novel and improved methods of and means for treating and processing bagasse and other vegetable fibrous materials so as to obtain a maximum yield of high quality depithed and decorticated fiber of optimum length and strength characteristics at a minimum yield of high quality depithed and decorticated fiber of optimum length and strength characteristics at a minimum cost. It is additionally an object to reduce the handling costs before, during and after fiber depithing.

The foregoing and other objects, characteristics and advantages of the present invention will be more clearly understood from the following description thereof when read in conjunction with the accompanying drawings in which.

The depithing devices which may be used in this invention are preferably of the vertical type as disclosed in U.S. Pat. Nos. 3,537,142 or 3,688,345. In essence, the depithed fiber exit conduit of a first vertical depither is connected to the input conduit of a second vertical depither. The depithed fiber from the first depither is delivered to the second depither in an air separated condition. By delivering the depithed fiber from a first depither to a second depither in an air separated condition, the second depither can more effectively work on the depithed fiber and produce a higher quality of fiber having a higher percentage of the pith removed therefrom. The quality of fiber and the degree of pith removal is significantly greater than when fiber is depithed once, collected and then depithed a second time. It is important that the fiber fall from the first depither to the second depither in an air separated condition.

It is also a part of this invention to spray water or another liquid onto the air separated fiber while the fiber is flowing from the first depither to the second depither. This liquid is preferably a mill waste water.

Also, part of this invention are systems for conveying fiber to be depithed to the first depithers from a loasing point, conveying pith from the first depithers and the second depithers, recycling excess fiber, and collecting both the pith and depithed fiber. These systems are applicable to first and second depithers wherein there is an addition of water to the air fluidized fiber as well as to the embodiments wherein there is no such addition.

Figure 1:
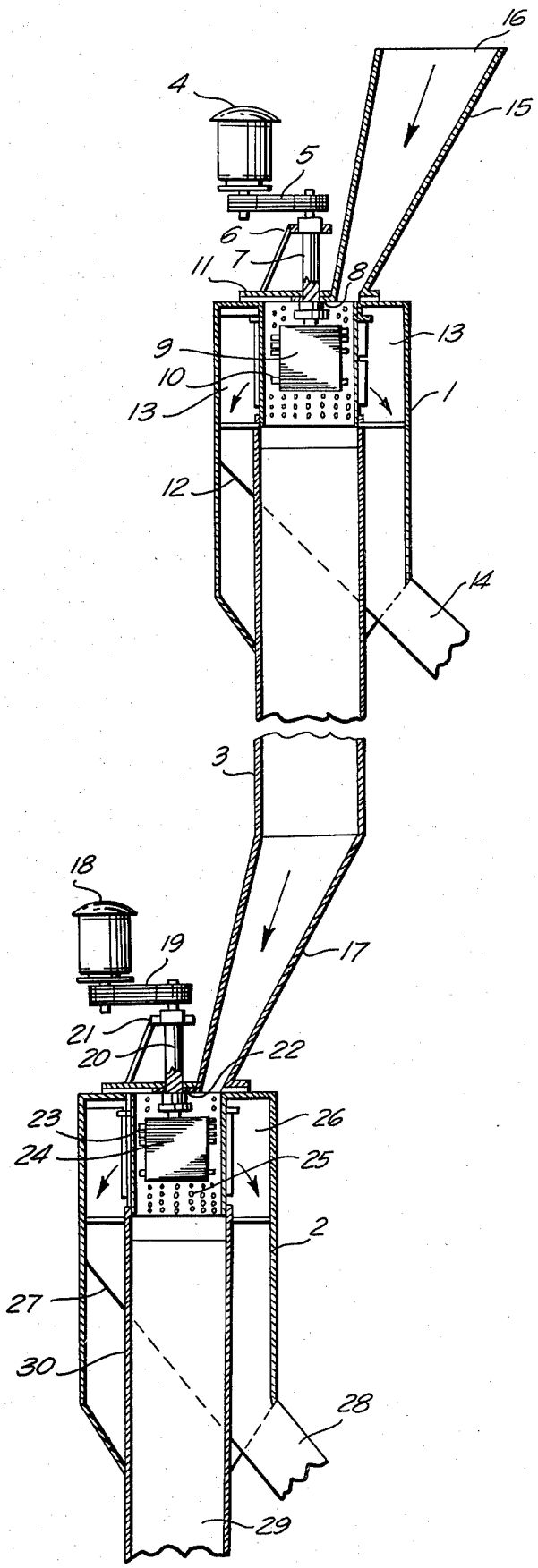
FIG. 1 is a side view, partially in section, schematically illustrating the general arrangement of the improved apparatus for processing bagasse in accordance with the present invention.

Referring to FIG. 1, which shows in schematic form the general arrangement of the apparatus of this invention, the reference numeral 1 denotes an outer casing of the first depither, which casing consists of top and side portions on the first depither. The numeral 2 denotes the outer casing of the second depither, which also consists of top and side portions. The conduit 3 is the conduit which gravitationally conducts the air separated fiber from the first depither to the second depither. Now more particularly in regard to the first depither the motor 4 drives shaft 7 by means of the slip belt drive arrangement 5. A direct gear drive with a slip clutch arrangement would be equivalent to the pully and belt arrangement 5. The shaft 7 is supported by means of the bearing braces 6 and 8. The shaft 7 is in a direct drive relationship to rotor 9 which carries a series of hammer knives 10. Encircling rotor 9 and in close relationship thereto is the screening element 11. The area 13 defined between the screen 11, the casing 1 and partition 12 is the zone for transport of pith which has passed through the screen to the depither outlet 14. In operation pith containing fiber enters chute 15 through opening 16. The fiber then flows into contact with rotor hammer knives 10 whereby the pith is removed from the fiber. The depithed fiber exits the first depither through conduit 3 and falls downwardly into chute 17 and thence into the second depithing zone. The pith passes through the screen to area 13 and exits the depither at outlet 14.

The second depither is usually similar in construction to the first depither. Like the first depither this second depither has a motor 18 which drives a shaft 20 through a pulley and slip belt arrangement 19. Some other equivalent mechanism may be used. The shaft 20 is supported by bearing braces 21 and 22. The shaft drives rotor 23 which carries a plurality of hammer knives 23. Encircling the rotor and in close spatial relation thereto is screen element 25. The pith removed from the fiber is forced through the screen and flows from the area 26 defined by the screen 25, casing 2 and partition 27 to outlet 28. The depithed fiber flows to outlet 29 by means of conduit 30.

This description broadly sets out the interconnection and operation of the dual depither arrangement of the present discovery. Although essentially any verticle depither as depicted in FIG. 1 can be used, the depithers of U.S. Pat. No. 3,537,142 and U.S. Pat. No. 3,688,345 are particularly advantageous. These patents are incorporated herein by reference in order to set forth a preferred method of using this discovery. However, the important feature is that the fiber flowing from the first depither to the second depither be maintained in an air separated condition during this flow.

Figure 2:
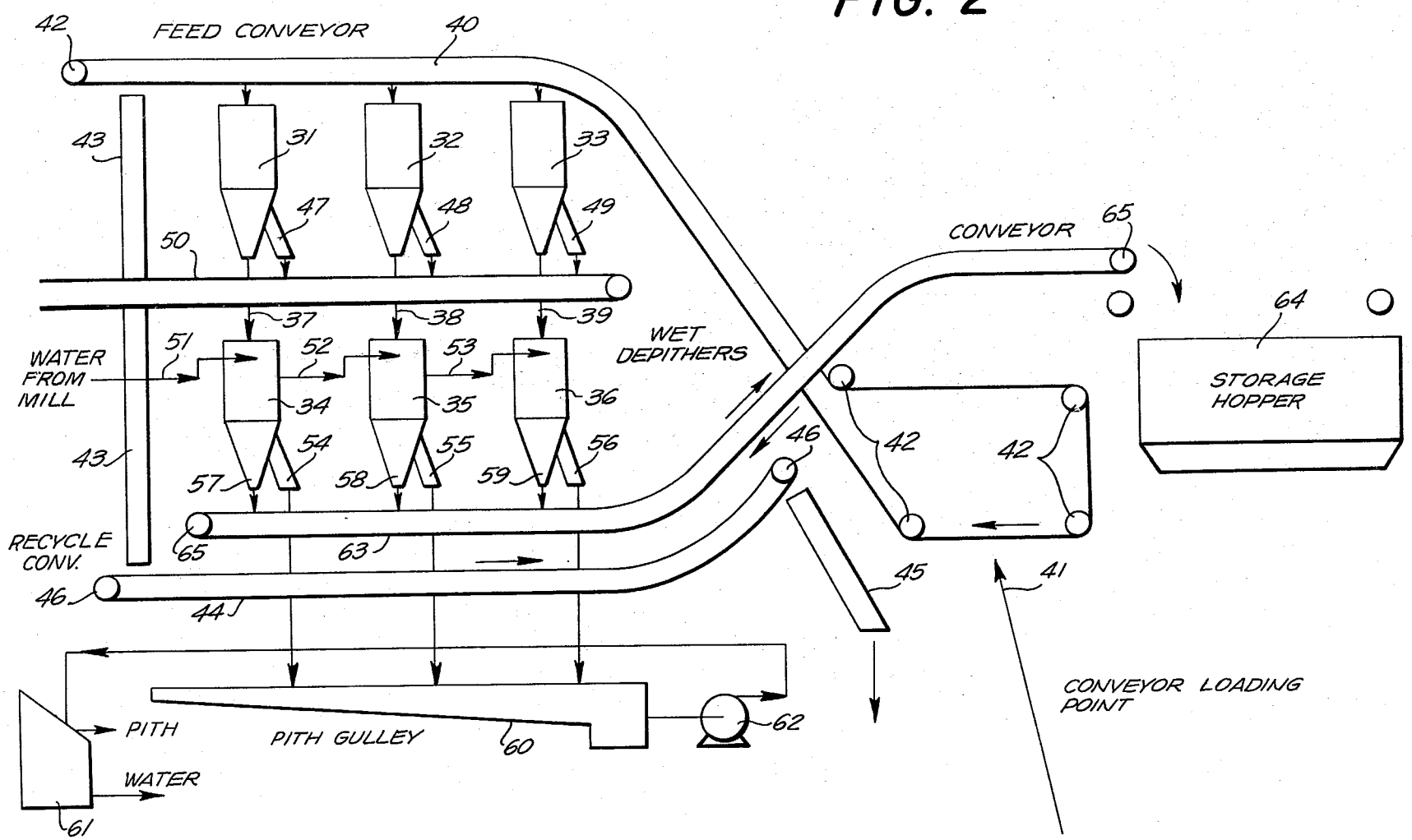
FIG. 2 is a schematic view of a fibrous material depithing system of the present invention illustrating the use of three dual zone depithing devices with the second zone consisting of a wet depithing.

Now, more particularly, in regard to FIG. 2 there is set forth a depithing system utilizing the present discovery. There is here set out a series of three first depithers 31, 32 and 33. These are interconnected to second depithers 34, 35 and 36 respectively by means of conduits 37, 38 and 39 respectively. The fiber falls from the first depither to the second depither through these conduits. The raw pith containing fiber is loaded onto feed conveyor 40 at feed conveyor loading point 41. Conveyor 40 is supported and driven by a plurality of rollers 42. Any known deflector means is used to flow the fiber from the conveyor to each first depither. Any excess fiber falls through chute 43 to recycle conveyor 44 which returns the fiber through chute 45 to the conveyor loading point. Conveyor 44 is operated and supported by means of roller 46. The pith which is removed from the fiber in the first set of depithers 31, 32 and 33, exits these depithers through outlets 47, 48 and 49 respectively. This pith falls onto conveyor 50 and is removed from the system.

In this embodiment the second set of depithers are wet depithers. These are similar to the depithers of U.S. Pat. No. 3,688,345. The water is preferably a waste water from the paper mill and is flowed to depithers 34, 35 and 36 through pipes 51, 52 and 53 respectively. The pith removed from the fiber exits these depithers by conduits 54, 55 and 56 respectively while the depithed fiber exits these second depithers by means of outlets 57, 58 and 59 respectively. The pith from these second depithers falls into pith gully 60 and is flowed to pith collector and separator 61 by means of pump 62. The depithed fiber falls onto conveyor 63 and is conveyed to collection hopper 64. Rollers 65 support and control this conveyor.

Figure 3:
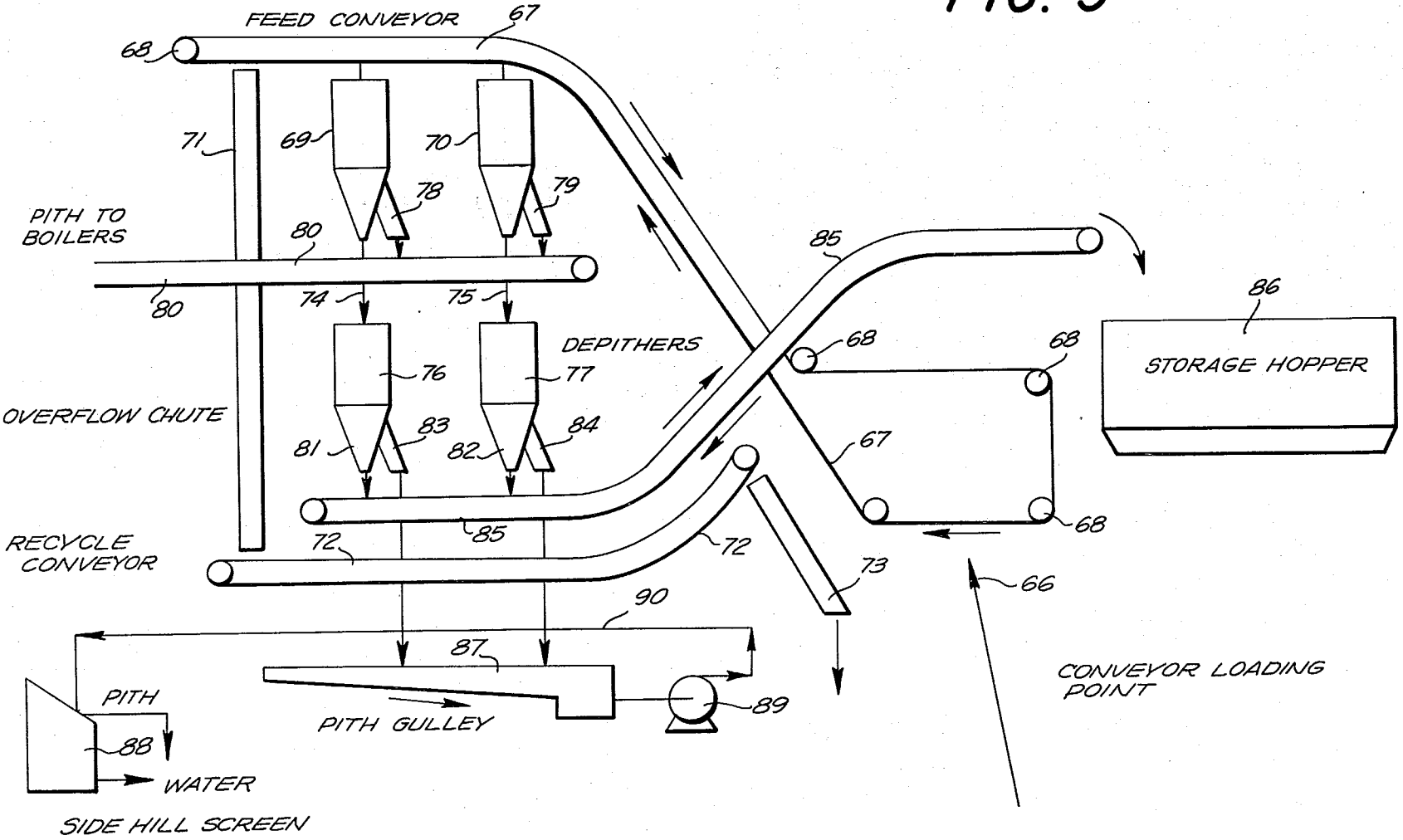
FIG. 3 is a schematic view of a fibrous material depithing system of the present invention illustrating the use of two dual zone depithing devices, both of which dry depith the fiber.

FIG. 3 discloses a system which uses two sets of depithers, all of which are dry depithers. Other than for these two differences, this embodiment is the same as that of FIG. 2. Therefore, since these systems are essentially the same, FIG. 3 will be discussed with reference to the operation of the systems of FIG. 2 and FIG. 3. Pith containing fiber is loaded at 66 onto feed conveyor 67 which is supported and controlled by rollers 68. Fiber is fed to depithers 69 and 70 from this conveyor with any excess fiber flowed through chute 71 to recycle conveyor 72 and thence to chute 73 which returns the fiber to loading point 66. The depithed fiber in depithers 69 and 70 falls through conduits 74 and 75 respectively to second depithers 76 and 77 respectively. The pith removed in first depithers 69 and 70 exits these depithers via outlets 78 and 79 respectively and is removed from the system by conveyor 80.

Again, it is important that the fiber in conduits 74 and 75 be in an air separated condition during transfer from the first depithers to the second depithers. The fiber falls from the exit of the first depither to the entrance to the second depither solely by gravity. The further depithed fiber exits the second depithers 76 and 77 at 81 and 82 respectively with the pith exiting at 83 and 84 respectively. The further depithed fiber falls onto conveyor 85 which transports this fiber to storage hopper 86. The pith falls into pith gully 87 and is flowed to pith collector and separator 88 by pump 89 and conduit 90.

The further depithed fiber is now in a condition for supply to a pulp digestor or for some other use. The pith is used as a chemical source material or it may be used as a fuel.

The arrangement of the first and second depithers should be as illustrated in the drawings. That is, the first depither should be above the second depither with a vertical or essentially vertical conduit directing depithed fiber from the outlet of the first depither to the inlet of the second depither.

As is set forth in U.S. Pat. No. 3,537,142, there is no auxiliary suction or blower used to make the fiber pass through each depither. The fibers while being worked on by the hammers, orient themselves vertically and more downwardly by means of the successive contacts by the hammers. The twist of the initial four hammers in the rotor assembly imparts a helical flow path to the material being processed as it proceeds vertically downwards through the treating zone. The rotating blades of the rotor assembly centrifugally fling the fragments against the screening element where a layer of axially aligned fibrous fragments will be formed on the inner surface of the element. These fragments are then rolled and rubbed on their axes over and across each other so as to break open the fragments and expose the pith to be removed. Since there are no extraneous artificially created air currents in the device, the fragments are very uniformly oriented so that the fibers tend to lay lengthwise on the inner surface of the screening element with their axes in alignment with the axis of the rotor assembly. When the fibers exit the first depither they fall solely under the force of gravity into the second depither. Within the second (lower) depither the fibers are further worked on to remove pith and are again propelled downwardly by means of contact by the hammers.

The use of a blower or of a suction means would negate the effectiveness of the individual depither devices and the present arrangement, and would to all practical purposes make them inoperable. That is, if a suction is drawn at the fiber outlet of the lower depither, there will result a fiber-pith mixture which is not useful for paper making. Air would be drawn in through the screen in each depither preventing pith from being forced through the screen in the other direction. And if air is forced into the bagasse inlet of the upper depither to propel the fibers through the dual depither device, the air will cause the fiber against the screen in each depither and, also, will propel pith along with fiber to the fiber outlet of the lower depither. That is, the higher the atmospheric air pressure within the depither will cause fibers to clog the screen holes and also due to the downward air flow pith will be carried along with the fiber. Further, there would be the problem of adjusting the air flow so that fiber from the first depithers would not pile up at the inlet to the second depither, thus obviating the advantages of the vertical dual depither arrangement.

The principal advantage of the present dual depither arrangement is a more highly depithed, higher quality fiber. Such fiber after pulping produces papers with higher strength and better quality. The systems of FIGS. 2 and 3 set forth the best modes contemplated for the use of the dual depither arrangement. The automated systems provide a good balance of system capital and operation cost, quality of fiber, and yield of fiber.

I claim:

1. An improvement in the method of processing fibrous vegetable materials containing pith for the separation of the pith from the fiber which method comprises feeding said fibrous vegetable materials into the upper inlet end of a first vertical depither consisting essentially of a cylindrical screen element having disposed therein a rotating element having an array of hammers, repeatedly contacting said fibrous vegetable materials with said array of hammers thereby vertically orienting said fibers on said screen element, separating and removing pith from said fibers by forcing said pith through said screen element and moving said fibers downwardly while vertically oriented, collecting depithed fibers exiting from a lower fiber outlet end of said first vertical depither, and subsequently as a separate operation feeding said fibers which have had a portion of pith removed therefrom into a second vertical depither for further separation of pith from said fiber, the improvement comprising, arranging said first vertical depither above said second vertical depither and interconnecting the lower fiber outlet end of said first vertical depither to the upper fiber inlet end of said second vertical depither whereby the fibers in a vertical orientation exiting the outlet end of said first depither fall downwardly and enter said second vertical depither while remaining in such vertical orientation thereby enhancing pith removal in said second vertical depither.

2. An improved method as in claim 1, wherein said first vertical depither and said second vertical depither are interconnected by means of a circular conduit.

3. An improved method as in claim 1, wherein said fiber falling downwardly from the fiber outlet end of said first depither to the inlet of said second depither is sprayed with a liquid.

4. An improved method as in claim 3, wherein said fibrous vegetable material is bagasse.

5. An improved method as in claim 1, wherein said fibrous vegetable material is bagasse.

6. An improved depithing system for processing fibrous vegetable material comprising at least two vertical depithing units, each vertical depithing unit consisting essentially of an upper fiber inlet for feeding fibrous vegetable material downwardly into a cylindrical chamber formed by a cylindrical screen element and having rotatably disposed therein an array of hammers which contact the fibers within said chamber, vertically orient said fibers on said screen element, remove pith from said fibers by forcing said pith through said screen element, and move said fibers downwardly in a vertical orientation along said screen element to the lower fiber outlet end of the depithing unit, the improvement comprising arranging said first depithing unit above said second depithing unit and interconnecting the fiber inlet end of said second depithing unit to the fiber outlet end of said first depithing unit by means of a conduit whereby fibers which have been vertically oriented within said first depithing unit remain in said vertical orientation and fall by gravity from the fiber outlet of said first depithing unit to the inlet of said second depithing unit where said fibers are rapidly oriented vertically on the cylindrical screen element of said second depithing unit and pith is further removed from said fibers.

7. An improved depithing system as in claim 6, wherein a liquid is sprayed onto said fiber in said second depithing unit.

8. An improved depithing system as in claim 6, wherein first conveyor means transports fibrous vegetable material to said first depithing unit, second conveyor means transports pith from said first depithing unit, and third conveyor means transports depithed fiber from said second depithing unit.

* * * * *